US010698352B2

(12) United States Patent
Koyama

(10) Patent No.: US 10,698,352 B2
(45) Date of Patent: Jun. 30, 2020

(54) FIXING APPARATUS

(71) Applicant: CANON KABUSHIKI KAISHA, Tokyo (JP)

(72) Inventor: Shoichi Koyama, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/418,396

(22) Filed: May 21, 2019

(65) Prior Publication Data

US 2019/0361379 A1 Nov. 28, 2019

(30) Foreign Application Priority Data

May 22, 2018 (JP) ..... 2018-097760

(51) Int. Cl.
*G03G 15/20* (2006.01)

(52) U.S. Cl.
CPC ..... *G03G 15/206* (2013.01)

(58) Field of Classification Search
CPC ..... G03G 15/2042; G03G 15/2046
See application file for complete search history.

(56) References Cited

U.S. PATENT DOCUMENTS 9,217,972 B2 * 12/2015 Taguchi ..... G03G 15/206
2015/0139708 A1 * 5/2015 Shimura ..... G03G 15/2042 399/329

FOREIGN PATENT DOCUMENTS

JP H10-232576 A 9/1998
JP H11-084919 A 3/1999
JP 2007003696 A * 1/2007

* cited by examiner

*Primary Examiner* — Erika J Villaluna
(74) *Attorney, Agent, or Firm* — Venable LLP

(57) ABSTRACT

An image fixing device including a cylindrical film, a heater, and a heat conduction member. The cylindrical film is contactable with toner unfixed on a sheet. The heater includes a substrate and a heat generating resistor provided on the substrate. The heat conduction member has a thermal conductivity higher than that of the substrate and is on a side of the substrate opposite from the heat generating resistor. The substrate is provided with non-insulating wiring patterns on a side opposite from the side provided with the heat generating resistor with respect to a direction perpendicular to a recording material feeding direction. The heat conduction member is in contact with one of the wiring patterns and is in contact with the substrate from a position of the substrate outside of an end of the heat generating resistor toward a central portion.

7 Claims, 7 Drawing Sheets

FIXING APPARATUS

FIELD OF THE INVENTION AND RELATED ART

The present invention relates to a fixing apparatus which is mountable in an image forming apparatus such as an electrophotographic copying machine or electrophotographic printer.

There have been known various fixing apparatuses which are mountable in an electrophotographic copying machine, an electrophotographic printer, or the like. One type of such fixing apparatus employs a heating film, and is structured to heat a toner image through the heated film. A fixing apparatus of this type comprises: a cylindrical film; a flat and rectangular heater which is placed in contact with the inward surface of the cylindrical film to heat the film; and a pressure roller which forms a nip between itself and the film in cooperation with the heater. Regarding the operation of a fixing apparatus of this type, first, it is put through a warm-up process in which the film is warmed up while the pressure roller and film are rotated. Then, a sheet of recording medium, on which an unfixed toner image is borne, is conveyed through the nip while remaining pinched by the film and pressure roller. While the sheet is conveyed through the nip, the sheet and the toner image thereon are heated by the film. Consequently, the unfixed toner image becomes fixed to the sheet.

When a substantial number of small (narrow) sheets of recording mediums are conveyed through a copying machine or a printer to form an image on the sheets, with the same intervals as the one for a large (wide) sheet of recording medium, the portions of the heater of the fixing apparatus, which are outside the path of a small sheet of recording medium (out-of-sheet-path portions), excessively increase in temperature. As the out-of-sheet-path portions excessively increases in temperature, it is possible that the film which is heated by the heater, and/or a holder by which the heater is held, will be damaged.

One of the known methods for preventing the portions of the heater of a fixing apparatus, which are outside the path of a small sheet of recording medium, from excessively increasing in temperature is to place a piece of metallic plate in contact with the entirety of the substrate of the heater, in order to improve the heater in thermal conductivity (Japanese Laid-open Patent Application No. H10-232576). The plate is placed in terms of the direction which is perpendicular to the direction in which a sheet of recording medium is conveyed through the fixing apparatus. There has been also know another method for improving the heater in thermal conductivity. In the case of this method, a piece of metallic plate is placed in contact with the entirety of the downstream side of the substrate of the heater, in the recording medium conveyance direction (Japanese Laid-open Patent Application No. H11-84919).

In the case of the fixing apparatuses described above, the portions of the nip, which are outside the path of a small sheet of recording medium, are prevented from excessively increasing temperature by the function of the metal plate. However, it is likely for the lengthwise end portions of the heater in terms of the recording medium conveyance direction to become lower in temperature than the center portion of the heater while the fixing apparatus (image forming apparatus) is warmed up. As the lengthwise end portions of the heater reduce in temperature, it is possible that as a large sheet of recording medium, on which an unfixed image is present, is conveyed through the fixing apparatus to fix the toner image, fixation failure will occur to the end portions of the large sheet of recording medium, in terms of the direction perpendicular to the recording medium conveyance direction. Therefore, it is desired to prevent the aforementioned portions of the heater from substantially reducing in temperature after the completion of the warm-up process.

Further, in consideration of the cost for assembling a fixing apparatus, the fixing apparatuses described above are likely to be structured so that the thermistors for detecting the temperature of the heater, and the patterned electrical wire which is in contact with the thermistors, are placed on the opposite surface of the heater substrate from the pressure roller. Therefore, it is desired that the piece of metallic plate, which has not been put through a process for making it insulative, is placed on the substrate without short-circuiting the patterned electrical wires.

Thus, the primary object of the present invention is to provide a fixing apparatus which is structured so that the patterned electrical wires for its heater is not short-circuited by its thermally conductive member, and also, that the lengthwise end portions of its heater do not significantly reduce in temperature after the completion of the warm-up process.

SUMMARY OF THE INVENTION

According to an aspect of the present invention, there is provided a fixing device for fixing an unfixed toner image on a recording material by heat, said fixed device comprising a cylindrical film contactable with the unfixed toner image formed on the recording material; a heater including a substrate and a heat generating resistor provided on said substrate, said substrate having a side close to said heat generating resistor being in contact with an inner surface of said film; a heat conduction member having a thermal conductivity higher than that of said substrate, said heat conduction member is provided on a side of said substrate opposite from said heat generating resistor, wherein said substrate is provided with a plurality of non-insulating wiring patterns on a side opposite from the side provided with said heat generating resistor with respect to a direction perpendicular to a recording material feeding direction, and wherein said heat conduction member is in contact with one of said wiring patterns and is in contact with said substrate from a position of said substrate outside of a end of said heat generating resistor toward a central portion.

Further features of the present invention will become apparent from the following description of exemplary embodiments with reference to the attached drawings.

Figure 3:
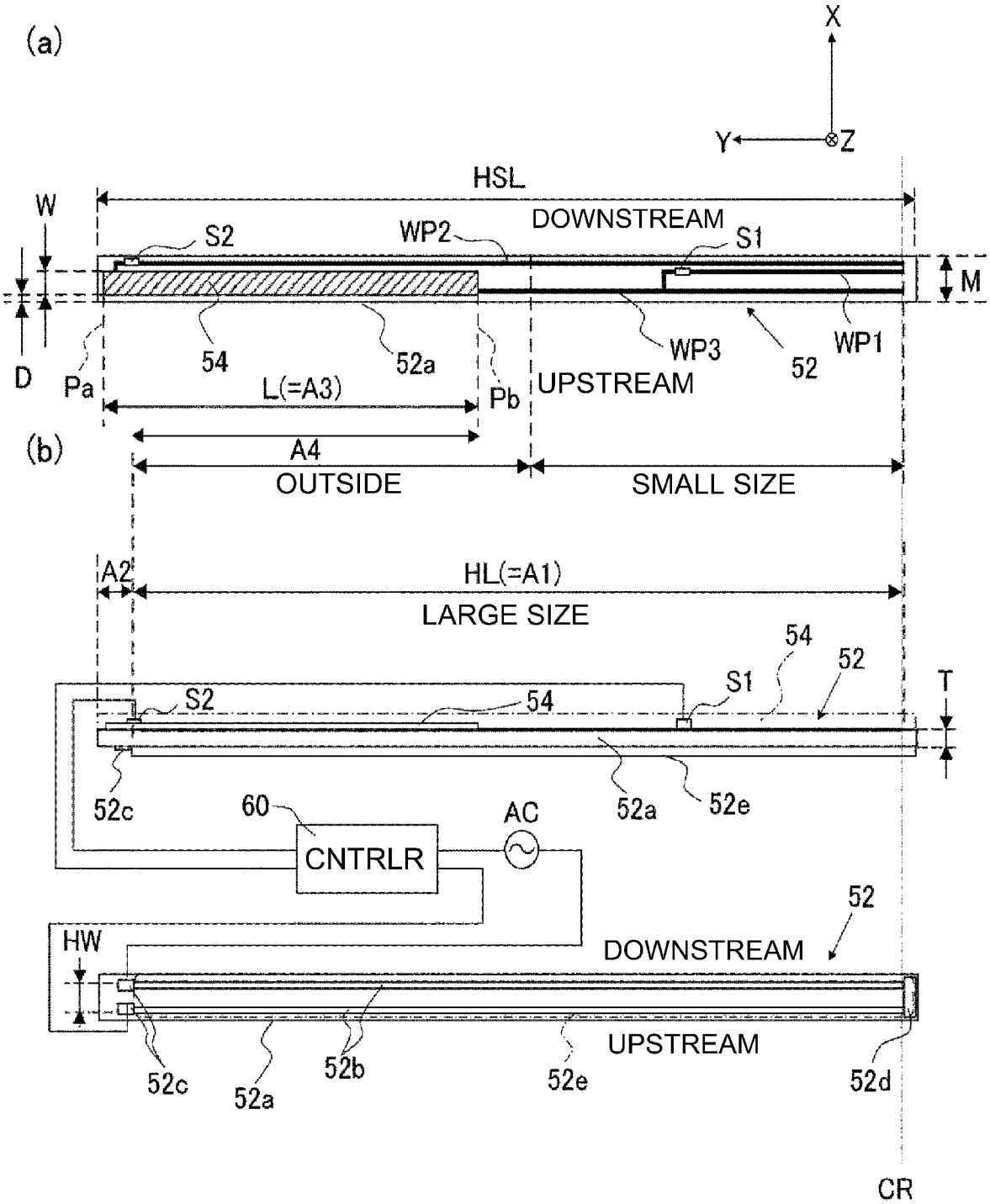

Parts (a) and (b) of FIG. 3 are schematic views illustrating the positional relationship between the heater and thermally conductive member.

Figure 4:
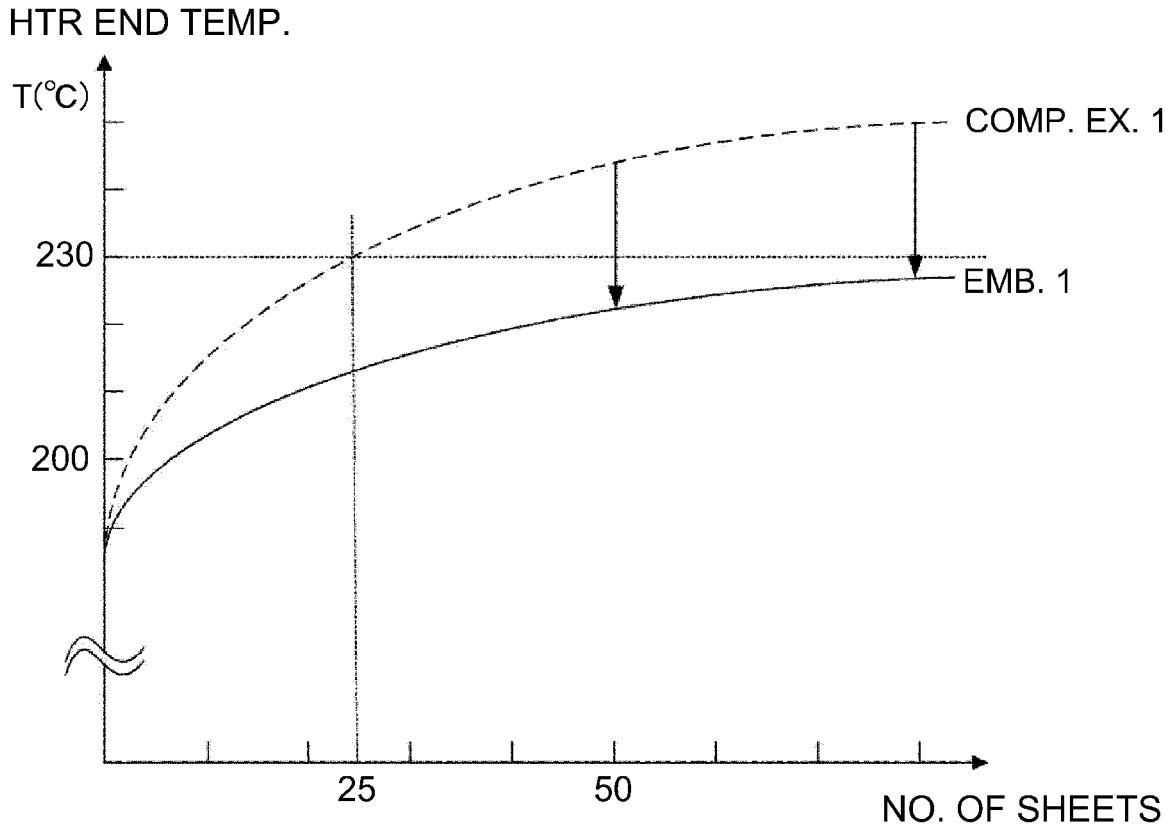

FIG. 4 is a graph which shows the relationship between the number of large sheets of recording medium conveyed through the fixing apparatus in the first embodiment and a comparative (conventional) fixing apparatus, and the temperature of the lengthwise end portions of the heater in the first embodiment, and the heater in the comparative fixing apparatus.

Figure 5:
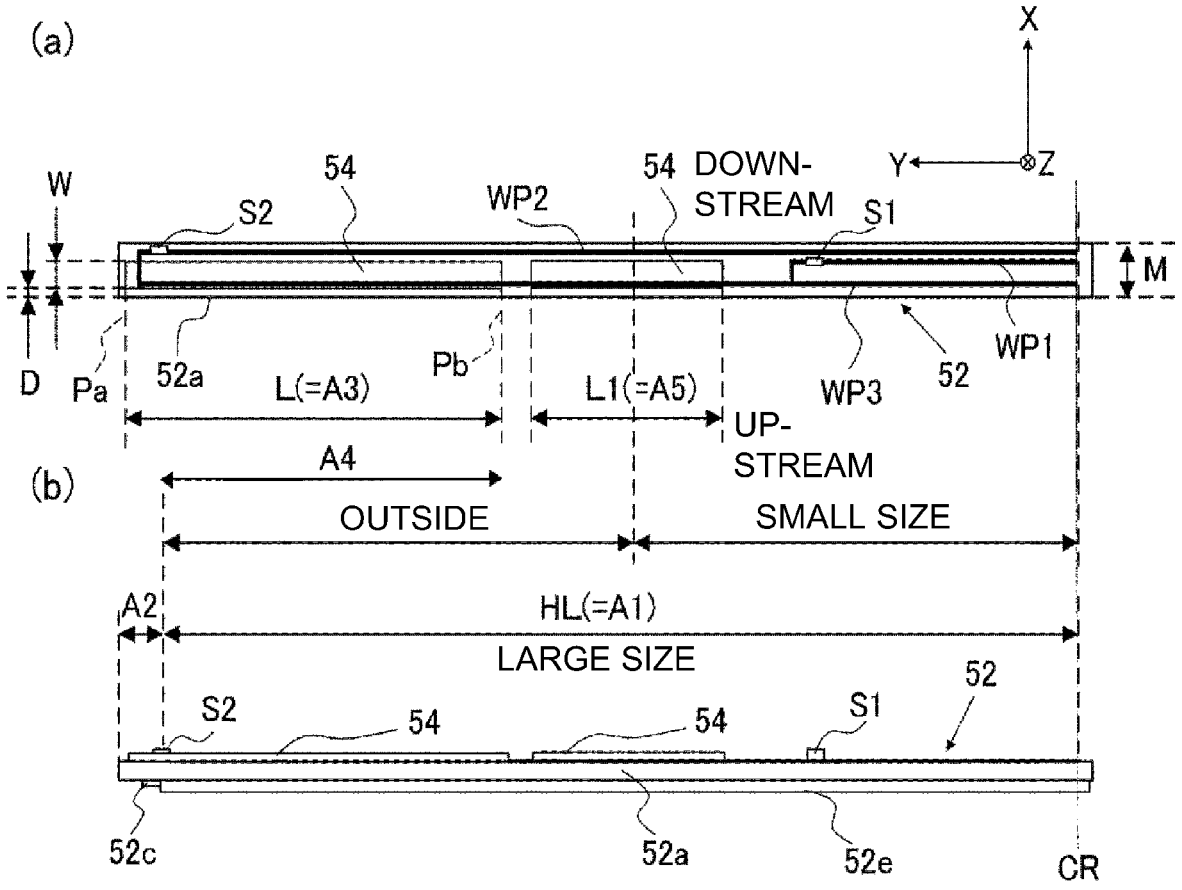

Parts (a) and (b) of FIG. 5 are schematic views illustrating the positional relationship between the heater and thermally conductive member of the fixing apparatus in the second embodiment of the present invention.

Figure 6:
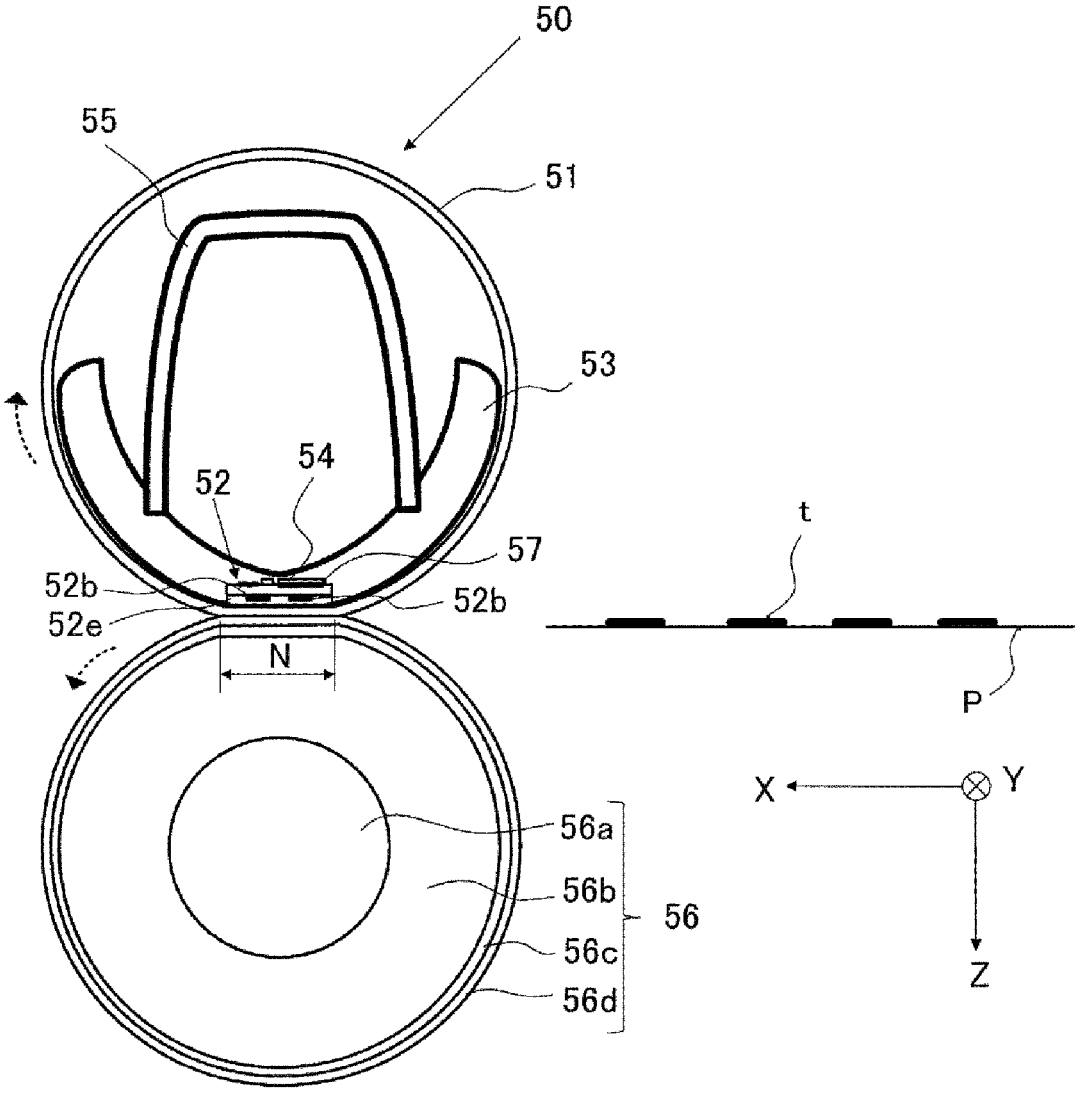

FIG. 6 is a sectional view of the fixing apparatus in the second embodiment of the present invention; it shows the general structure of the apparatus.

Figure 7:
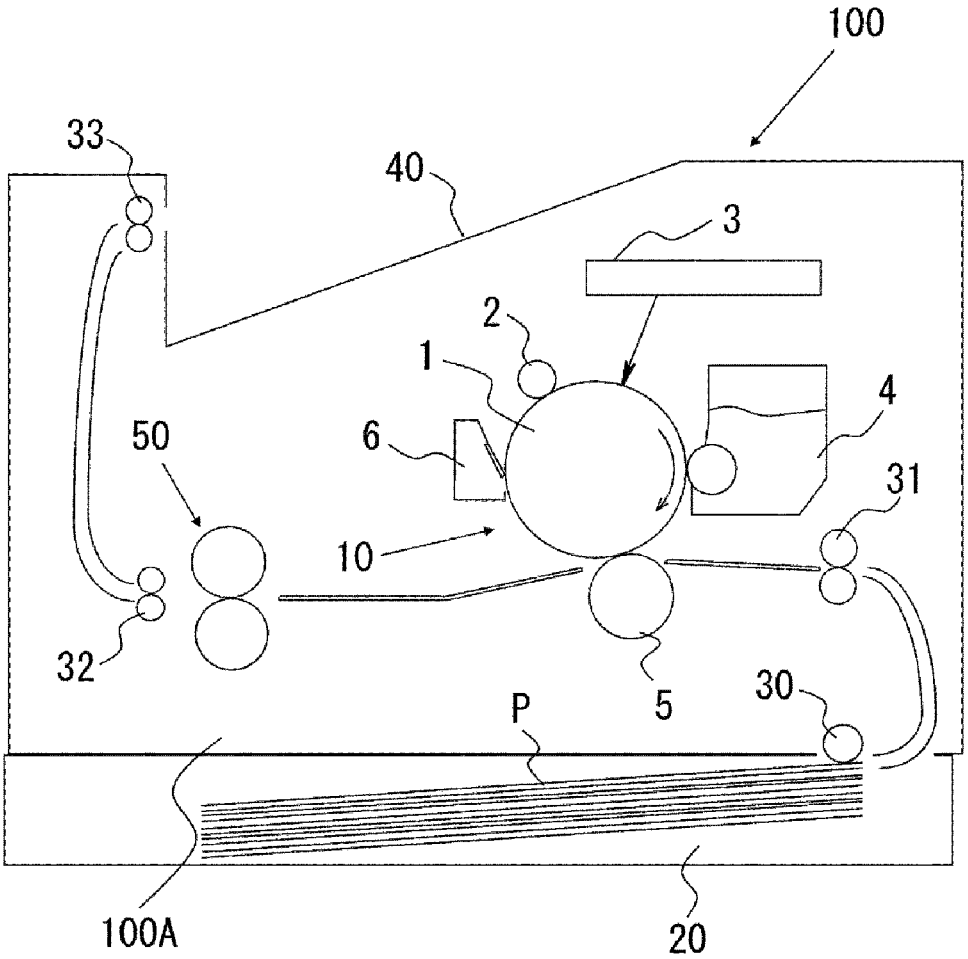

FIG. 7 is a schematic sectional view of a typical image forming apparatus, with which the present invention is compatible; it shows the general structure of the apparatus.

DESCRIPTION OF THE EMBODIMENTS

Hereinafter, a few of the preferred embodiments of the present invention are described with reference to appended drawings. The following embodiments of the present invention are examples of the preferred embodiments of the present invention and are not intended to limit the present invention in scope. That is, the present invention is also applicable, within its scope, to various fixing apparatuses which are different in structure from those in the following embodiments.

EMBODIMENT 1

(1) Image Forming Apparatus 100

Referring to FIG. 7, an image forming apparatus 100 which has the fixing apparatus 50 of this embodiment is described. FIG. 7 is a schematic sectional view of an image forming apparatus 100 (monochromatic printer) based on an electrophotographic recording technology, showing the general structure of the apparatus 100. This image forming apparatus 100 is structured so that when a sheet of recording medium is conveyed through the apparatus 100, one of the edges of the sheet is kept in contact with the corresponding edge (positional referential edge for recording medium conveyance) of the recording medium passage of the apparatus 100.

The image forming portion 10 of the image forming apparatus 100, which forms an image on a sheet P of recording medium with the use of toner, has a photosensitive drum 1 (image bearing member), a charging member 2, a laser scanner 3, a developing device 4, a transferring member 5, and a cleaner 6 for cleaning the peripheral surface of the photosensitive drum 1. The operation of the image forming portion 10 is well-known, and therefore, is not described in detail.

The sheets P of recording medium stored in a cassette 20 in the apparatus main assembly 100A are delivered one by one to a roller 31 by the rotation of a roller 30. Then, each sheet P is conveyed by the rotation of the roller 31 to a transferring portion formed by the photosensitive drum 1 and transferring member 5. Then, an unfixed toner image is transferred onto the sheet P, in the transferring portion. After the transfer of the unfixed toner image onto the sheet P, the sheet P is sent to a fixing apparatus 50 as a fixing portion, in which the unfixed toner image is thermally fixed to the sheet P. After coming out of the fixing apparatus 50, the sheet P is discharged into a delivery tray 40 by the rotation of rollers 32 and 33.

(2) Fixing Apparatus 50

Figure 1:
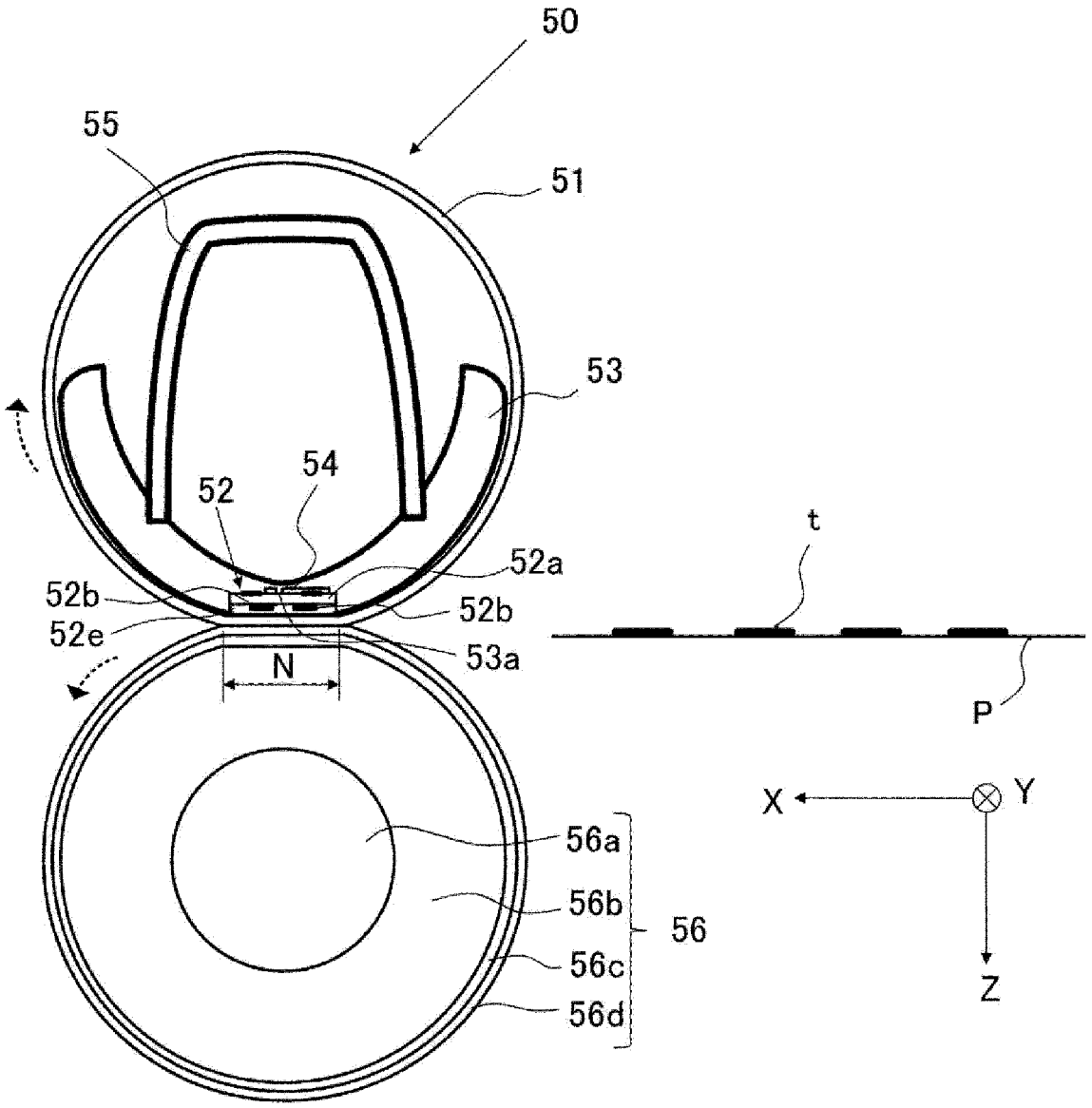
FIG. 1 is a sectional view of the fixing apparatus in the first embodiment of the present invention; it shows the general structure of the apparatus.
Figure 2:
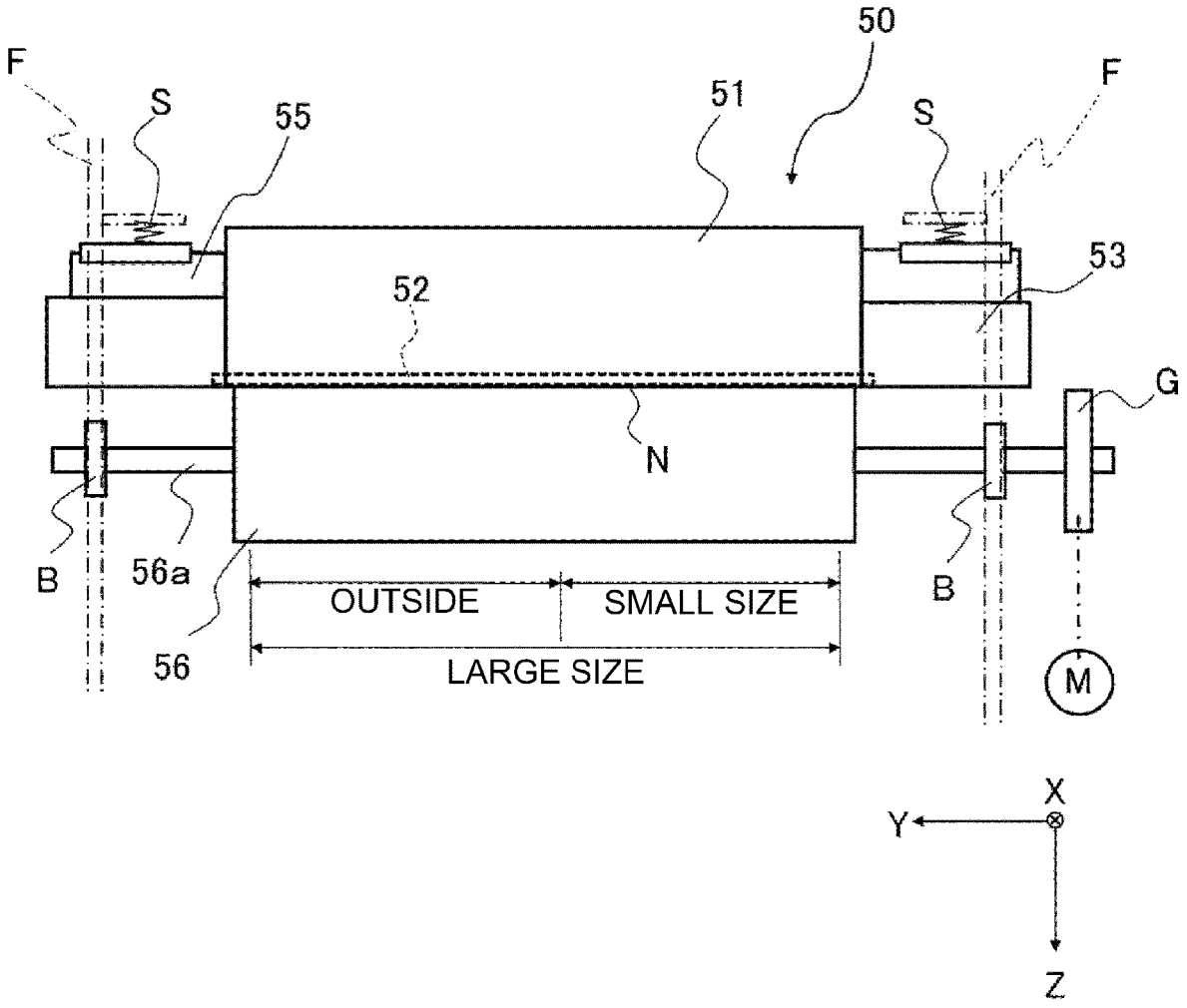
FIG. 2 is a side view of the fixing apparatus, shown in FIG. 1, as seen from the upstream side of the apparatus in terms of the recording medium conveyance direction X.

Next, referring to FIGS. 1 and 2, the fixing apparatus 50 is described. The fixing apparatus 50 in this embodiment is such a fixing apparatus that is structured so that its heater heats a sheet P of recording medium and the toner image thereon, through a film. FIG. 1 is a schematic sectional view of the fixing apparatus 50. It shows the general structure of the fixing apparatus 50. FIG. 2 is a side view of the fixing apparatus 50 shown in FIG. 1, as seen from the upstream side of the apparatus 50 in terms of the recording medium conveyance direction X.

The fixing apparatus 50 has: a cylindrical film 51; a ceramic heater 52 which is in contact with the inward surface of the cylindrical film 51; a holder 53 which supports the heater 52; and a thermally conductive member 54 positioned between the heater 52 and holder 53. Further, it has: a stay 55 as a member for reinforcing the holder 53; and a pressure roller 56 as a backup member, which forms a nip N between itself and the film 51, in cooperation of the heater 52.

Next, referring to parts (a) and (b) of FIG. 3, the heater 52 is described. Part (a) of FIG. 3 is a schematic drawing of the opposite side of the heater 52 from the roller 56. It shows the general structure of the heater 52. The top drawing of part (b) of FIG. 3 is a side of the heater 52 as seen from the upstream side of the heater 52 in terms of the recording medium conveyance direction X. It shows the general structure of the heater 52. The bottom drawing of part (b) of FIG. 3 is a drawing of the heater 52 as seen from the roller 56 side. It also shows the general structure of the heater 52. A referential code CR in parts (a) and (b) of FIG. 3 stands for a positional referential line for recording medium conveyance.

The heater 52 has a substrate 52*a*, which is long and narrow. It is provided with a pair of heat generating resistors 52*b* which generate heat as electrical current is flowed through them, and which are placed on the roller 56 side of the substrate 52*a*, in such a manner that they extend in the lengthwise direction of the substrate 52*a*. Further, it is provided with a pair of electrodes 52*c* which are placed on one of the lengthwise end portions of the roller 56 side of the substrate 52*a* (which hereafter may be referred to as heat generating resistor 52*b* side surface), being in electrical connection to the pair of heat generating resistors 52*d*, one for one. Further, it is provided with an electrically conductive portion 52*c* which also is placed on the heat generating resistor 52*b* side surface of the other lengthwise end portions of the substrate 52*a*, being in electrical connection to the pair of heat generating resistors 52*b*. Moreover, the heater 52 is provided with a protective layer 52*e*, which is on the heat generating resistor 52*b* side surface of the substrate 52*a*, covering the pair of heat generating resistors 52*b* and electrically conductive portion 52*d*.

The substrate 52*a* is formed of alumina or aluminum nitride. The pair of heat generating resistors 52*b*, pair of electrodes 52*c*, and common electrode 52*d* on the substrate 52*a* are formed of silver-palladium by screen printing. The protective layer 52*e* is formed of a glass that is dielectric and pressure resistant.

The heater 52 is provided with a pair of thermistors S1 and S2 as temperature detecting members, which are on the opposite surface of the substrate 52*a* from the heat generating resistor 52*b* side. Regarding the nip N, in terms of the direction Y which is perpendicular to the recording medium conveyance direction X, the thermistor S1 is positioned in such an area that both small and large sheets of recording medium pass (which hereafter may be referred to as path of small sheet). The thermistor S2 is positioned in such an area that a large sheet of recording medium passes, but a small sheet of recording medium does not (which hereafter may be referred to as out-of-small-sheet-path area). It is disposed on the opposite end portion of substrate 52*a* from the recording medium conveyance positional reference line CR.

In this embodiment, the area of the sheet passage, which is 90 mm wide with reference to the lengthwise end of the heat generating resistor 52*b* on the recording medium conveyance referential line CR side, is referred to as the path of a small sheet of recording medium, whereas the area of the sheet passage, which is 216 mm wide with reference to the lengthwise end of the heat generating resistor 52*b*, on the recording medium conveyance referential line side, is referred to as the path of a large sheet of recording medium.

The heater 52 is also provided with multiple patterned electrical wires, more specifically, the first, second, and third patterned electrical wires WP1, WP2 and WP3, respectively, which are on the opposite surface of the substrate 52*a* from the heat generating resistor 52*b* side. In terms of the direction Y which is perpendicular to the recording medium conveyance direction X, the patterned electrical wire WP1 is in electrical connection to the thermistor S1, in the path of a small sheet of recording medium. The patterned electrical wire WP2 is in electrical connection to the thermistor S2, in the area which is outside the path of a small sheet of recording medium. The patterned electrical wire WP3 is in electrical connection to not only the thermistor S2, in the path of a small sheet of recording medium path, but also, the patterned electrical wire WP2, in the out-of-sheet-path area. All of the patterned electrical wire WP1, WP2 and WP3 are electrically uninsulated.

The heat resistant holder 53 is formed of liquid polymer, phenol resin, PPS (polyethersulfone), or PEEK (polyphenylsulfide). In terms of the direction Y which is perpendicular to the recording medium conveyance direction X, the holder 53 has a recess 53*a*, which is in the flat surface of the holder 53, which is on the roller 56 side (FIG. 2). The heater 52 is supported by the holder 53 by being placed in this recess 53*a*. In this embodiment, the holder 53 supports the heater 52 in such a manner that the center of the heater 52, and the lengthwise end portions (flat portions) of the heater 52, are in contact with the holder 53.

The heat resistant film 51 is loosely fitted around the holder 53. The holder 53 supports the heater 52 and guides the film 51 as the film 51 is rotated.

The fixing apparatus 50 is provided with a metallic stay 55, which is attached to the opposite surface of the holder 53 from the roller 56 side, in terms of the direction Y which is perpendicular to the recording medium conveyance direction X. The stay 55 has the function of reinforcing the holder 53.

The roller 56 has: a metallic core 56*a*; an elastic layer 56*b* formed on the peripheral surface of the metallic core 56*a* in a manner to envelop the metallic core 56*a*; an adhesive layer 56*c* formed on the peripheral surface of the elastic layer in a manner to cover the entirety of the peripheral surface of the elastic layer 56*b*; and a release layer 56*d* formed on the peripheral surface of the adhesive layer 56*c* in a manner to cover the entirety of the peripheral surface of the adhesive layer 56*c*. The metallic core 56*a* is formed of a metallic substance such as aluminum and iron. The elastic layer 56*b* is formed of heat resistant rubber such as silicone rubber and fluorinated rubber. The adhesive layer 56*c* is a layer of silicone rubber coated on the peripheral surface of the elastic layer 56*b*. The release layer 56*d* is a piece of fluorinated resin tube fitted around the adhesive layer 56*c* in a manner to cover the peripheral surface of the adhesive layer 56*c*, or a layer of fluorinated rubber coated on the peripheral surface of the adhesive layer 56*c* in a manner to cover the entirety of the peripheral surface of the adhesive layer 56*c*.

Referring to FIG. 2, the roller 56 is rotatably supported by the left and right frames F of the fixing apparatus 50, in terms of the direction Y which is perpendicular to the recording medium conveyance direction X. More specifically, the lengthwise end portions of the metallic core 56*a* are rotatably supported by a pair of bearings B attached to the left and right frames F of the fixing apparatus 50. It is also by the left and right frames F that the lengthwise end portions of the holder 53 and those of the stay 55 are supported.

The lengthwise end portions of the stay 55 are under the pressure generated by a pair of springs S in the direction perpendicular to the generatrix of the film 51. With the presence of this pressure, the holder 53 keeps the heater 52 pressed on the inward surface of the film 51. Therefore, the outward surface of the film 51 remains pressed on the peripheral surface of the roller 56. Therefore, the elastic layer 56*b* of the roller 56 is elastically deformed. Consequently, a nip N, which has a preset width in terms of the recording medium conveyance direction X is formed by the outward surface of the film 51 and the peripheral surface of the roller 56.

Next, the thermal fixing operation of the fixing apparatus 50 is described.

One of the lengthwise ends of the metallic core 56*a* includes a gear G. The gear G is rotated by a motor M (FIG. 2). The roller 56 rotates in the direction indicated by an arrow mark in FIG. 1. Thus, the film 51 rotates in the same direction (indicated by arrow mark in FIG. 1) as the roller 56, with its inward surface sliding on the protective layer 52*e* of the heater 52.

Referring to part (b) of FIG. 3, the temperature of the heater 52 is controlled by a control portion 60 of a circuit. As electric power is supplied to the heat generating resistors 52*b* by way of the electrodes 52*c* of the heater 52, the heat generating resistors 52*b* generate heat. Thus, the heater 52 quickly increases in temperature. The control portion 60 controls the amount of electrical power supplied to the heater 52 so that the temperature of the heater 52, which is detected by the thermistors S1 and S2, remains at a preset target level (fixation temperature).

A sheet P of recording medium, which is bearing an unfixed toner image t, is conveyed through the fixing apparatus 50 while remaining pinched by the nip N and being heated by the heat from the heater 52. Thus, the unfixed toner image t on the sheet P becomes fixed to the sheet P.

(3) Thermally Conductive Member 54

Next, referring to FIGS. 1, 3(*a*) and 3(*b*), the thermally conductive member 54 is described.

The material for the thermally conductive member 54 needs to be higher in thermal conductivity per unit area than the substrate 52*a* of the heater 52. Therefore, an electrically conductively substance such as aluminum, copper, silver, and the like, or a sheet of graphite is used as the material for the thermally conductive member 53. The sheet of graphite should be no more than 100 μm in thickness so that it is flexible.

Next, a method for attaching the thermally conductive member 54 to the substrate 52*a* is described. As the heater generates heat, the substrate 52*a* likely expands because of the heat. Therefore, the substrate 52*a* is likely to warp due to its thermal expansion, making it likely that the state of contact between the thermally conductive member 54 and substrate 52*a* will deteriorate. As the fixing apparatus 50 deteriorates in the state of contact between the thermally conductive member 54 the substrate 52*a*, the thermally conductive member 54 fails to prevent the portion of the recording medium passage, which is out of the path of a small sheet of recording medium, from excessively increasing in temperature. In this embodiment, therefore, the fixing apparatus 50 is not structured to attach the thermally conductive member 54 to the substrate 52*a* with adhesive. Further, if the fixing apparatus 50 is structured so that the thermally conductive member 54 is formed on the substrate 52*a* by screen-printing with the use of metallic paste, it is difficult to form the thermally conductive member 54 thick enough to provide the thermally conductive member 54 with a sufficient amount of thermal capacity. Therefore, this structure arrangement also is not used in this embodiment.

Referring to FIG. 1 and the top drawing of part (b) of FIG. 3, the fixing apparatus 50 in this embodiment is structured so that the thermally conductive member 54 is sandwiched by the holder 53 and the substrate 52*a* of the heater 52. This structural arrangement prevents the problem that, as the substrate 52*a* is made to expand by the heat from the heater 52, the fixing apparatus 50 the state of contact between the thermally conductive member 54 and the substrate 52*a* deteriorates, even if the thermally conductive member 54 is different in thermal conductivity from the substrate 52*a*. Thus, this structural arrangement is meritorious in that it can reliably prevent the portion of the recording medium passage, which is outside the path of a small sheet of recording medium, from excessively increasing in temperature.

Further, the fixing apparatus 50 in this embodiment is structured so that in terms of the direction Y which is perpendicular to the recording medium conveyance direction X, the length of the heat generating resistor 52*b* is greater than the width of a large sheet of recording medium. More concretely, the length of the heat generating resistor 52*b* is 218 mm, whereas the width of a large (LTR size) sheet of recording medium is 216 mm in width. In a case where the thermally conductive member 54 is placed in contact with the substrate 52*a* in such a manner that it contacts the entirety of the heat generating resistor 52*b*, heat radiates from the end portions of the heater 52, and therefore, the end portions of the heat generating resistor 52*b* reduces in temperature, causing therefore the problem that when an image is printed on a large sheet of recording medium, the portions of the image, which correspond in position to the end portions of the sheet in terms of the direction perpendicular to the recording medium conveyance direction X fail to be properly fixed to the sheet.

Therefore, in the case of the fixing apparatus 50 in this embodiment, the thermally conductive member 54 is placed in contact with the substrate 52*a* in such a manner that it extends from a point of the substrate 52*a*, which is on the outward side of the corresponding lengthwise end of the heat generating resistor 52*b*, toward the center of the substrate 52*a*.

Next, referring to part (a) of FIGS. 3 and 3(*b*), the size of the substrate 52*a*, size of the thermally conductive member 54, and the positional relationship among the thermally conductive member 54, patterned electrical wires WR1, WR2 and WR3, are described.

Referring to part (a) of FIGS. 3 and 3(*b*), the substrate 52*a* is 260 mm in length HSL in the direction Y which is perpendicular to the recording medium conveyance direction X, 10 mm in width M in terms of the recording medium conveyance direction X, and 1.0 mm in thickness T in terms of the direction parallel to the thickness direction of a sheet of recording medium. The heat generating resistors 52*b* are 218 mm in length HL in terms of the direction Y which is perpendicular to the recording medium conveyance direction X.

In terms of the direction Z which is parallel to the thickness direction of a sheet of recording medium, the thermally conductive member 54 is 0.3 mm in thickness. In terms of the direction Y which is perpendicular to the recording medium conveyance direction X, the length L by which the thermally conductive member 54 is in contact with the substrate 52*a* is roughly 90 mm. That is, the area of contact between the thermally conductive member 54 and substrate 52*a* is roughly 90 mm. In terms of the recording medium conveyance direction X, the width W of the thermally conductive member 54 is 4.5 mm, and is less than the distance HW between the upstream and downstream edges of the heat generating resistor 52*b* in terms of the recording medium conveyance direction X.

In terms of the direction Y which is perpendicular to the recording medium conveyance direction X, the substrate 52*a* of the heater 52 in this embodiment has: the first area A1 (=HL), which is provided with heat generating resistor 52*a*; and the second area A2 which is on the outward side of the first area, and is provided with no heat generating resistor.

Further, the substrate 52*a* of the heater 52 has the third area A3, which extends from a point which is on the outward side of the path of a small sheet of recording medium, in the first area A1 of the heater 52 to a point which is on the outward side of the end of the heat generating resistor 52*a*, in the second area A2. The thermally conductive member 54 is placed in contact with the substrate 52*a* in such a manner that it covers the area A3. That is, the thermally conductive member 54 is placed in contact with the substrate 52*a* in such a manner that it extends from a point Pa which is on the outward side of the end of the heat generating resistor 52*b* of the heater 52 to a point Pb which is on the inward side of an area A4 where the path of a large sheet of recording medium overlaps with that of a small sheet of recording medium.

Referring to part (a) of FIG. 3, the thermally conductive member 53 is in contact with the patterned electrical wire WR3, that is, one of the three patterned electrical wires WR1, WR2 and WR3, but is not in contact with the other patterned electrical wires WR2 and WR3, Preventing the patterned electrical wire WR1 from being short-circuited with the patterned electrical wires WR2 and WR3 by the thermally conductive member 54. Referring again to part (a) of FIG. 3, in terms of the recording medium conveyance direction X, the distance D between the upstream edge of the substrate 52*a* and that of the thermally conductive member 53 was made to be no less than 2 mm to ensure that the distance D is large enough to keep the thermally conductive member 53 insulated from the primary electrode 52*c* of the power source.

Next, referring to FIG. 4, the relationship between the number of large sheets of recording medium conveyed through each of the fixing apparatus 50 in this embodiment and a comparative fixing apparatus, and the temperature of the end portion of the heater 52, are described. The temperature of the end portion of the heater 52 means the temperature detected by the thermistor S2.

In the case of the first comparative fixing apparatus equipped with a heater (52) having no thermally conductive member (54), there was no problem in the fixation of the toner image t to the edge portions of a large sheet of recording medium until the number of sheets conveyed through the fixing apparatus was no more than 25. However, as the number exceeded 25, the roller temperature exceeded 230° C., which is the highest level tolerable by the roller 6.

In comparison, in the case of the fixing apparatus 50 in this embodiment which has the heater 52, the substrate 52*a* of which is provided with the thermally conductive member 54, the roller temperature did not exceed 230° C., or the highest temperature tolerable by the roller 6. Further, the fixation of the toner image to the edge portions of a large sheet of recording medium in terms of the direction perpendicular to the recording medium conveyance direction X was at a tolerable level for the following reason. That is, the thermally conductive member 54 was placed in contact with the substrate 52*a*, within the area A3 of the heater 52. It was thought, therefore, that the heat from the end portions of the heater 52 was transferred to the portion of the heater 52, which corresponds in position to the path of a small sheet of recording medium, through the portion of the thermally conductive member 54, which corresponds in position to the portion of the recording medium passage, which is outside the path of a small sheet of recording medium. Consequently, the end portions of the heater 52 was prevented from excessively increasing in temperature; the heater 52 was properly balanced in temperature distribution. That is, it was possible for this embodiment to reliably prevent the problem that the portion of the heater 52, which corresponds in position to the portion of the recording medium passage, which is outside the path of a small sheet of recording medium, from excessively increasing in temperature. Therefore, it was possible to prevent the problem that when a substantial number of large sheets of recording medium are used, the edge portion of the sheet suffers from unsatisfactory fixation.

As described above, the fixing apparatus 50 in this embodiment can prevent the problem that the patterned electrical wires WR1, WR2 and WR3 are short-circuited by the thermally conductive member 54, and also, the problem that the end portion of the heater 52 tends to reduce in temperature right after the completion of the warm-up period. That is, because this embodiment can prevent the end portion of the heater 52 from reducing in temperature, it can prevent the occurrence of the unsatisfactory fixation which tends to occur to the edge portion of a large sheet of recording medium.

In this embodiment, the thermistors S1 and S2 formed separately from the substrate 52*a* were attached to the substrate 52*a*. However, they may be formed on the substrate 52*a* by printing.

EMBODIMENT 2

Next, another example of fixing apparatus 50 which is in accordance with the present invention is described. In the following, the parts of the fixing apparatus 50, which are different from those of the fixing apparatus 50 in the first embodiment, are described. The fixing apparatus 50 in this embodiment is characterized in that it is provided with two thermally conductive members 54, which are placed in contact with different portions of the substrate 52*a*.

Referring to parts (a) and (b) of FIG. 5, the fixing apparatus 50 in this embodiment structured so that two thermally conductive members 54 are placed in contact with the two different portions of the substrate 52*a*, one for one, is described about its structure. Part (a) of FIG. 5 is a schematic drawing of the heater 52 as seen from the roller 56 side. It shows the general structure of the heater 52. Part (b) of FIG. 5 is a schematic side view of the heater 52 as seen from the upstream side of the heater 52 in terms of the recording medium conveyance direction X. It also shows the general structure of the heater 52.

In terms of the direction Y which is perpendicular to the recording medium conveyance direction X, one of the thermally conductive members 54 is placed in the area A3 of the heater 52, which was described in the description of the first embodiment, and the other thermally conductive member 54 is placed in an area A5 of the heater 52, which straddles both the portion of the heater 52, which is outside the path of a small sheet of recording medium, and the portion of the heater 52, which is within the path of a small sheet of recording medium. As for the measurement of the area A5, the portion of the area A5, which is outside the path of a small sheet of recording medium, is 20 mm, and the portion of the area A5, which is within the path of a small sheet of recording medium is 15 mm.

The fixing apparatus 50 in this embodiment can provide the effects similar to those obtainable by the fixing apparatus 50 in the first embodiment, by the thermally conductive members 54 placed in the area A3 of the heater 52. Further, the fixing apparatus 50 can prevent the problem that unsatisfactory fixation occurs to the edge portion of a small sheet of recording medium, by the other thermally conductive member 54 which is placed in the area A5 of the heater 52.

EMBODIMENT 3

Next, another fixing apparatus 50 which is in accordance with the present invention is described. In the following, the parts of the fixing apparatus, which are different from the counterparts in the fixing apparatuses 50 in the first and second embodiments, are described. The fixing apparatus 50 in this embodiment is characterized in that it is provided with an auxiliary thermally conductive member 57, which is placed between the substrate 52*a* of the heater 52, and the thermally conductive member 54.

FIG. 6 is a schematic sectional view of the fixing apparatus 50 in this embodiment. It shows the general structure of the fixing apparatus 50.

In a case where the image forming apparatus 100 is used for a substantial length of time, it is possible for the substrate 52*a* and/or thermally conductive member 54 to be made to expand or deform, by the thermal stress which is caused by the electric power inputted into the heat generating resistor 52*b* of the heater 52. Further, the thermally conductive member 54 is held between the holder 53 and the substrate 52*a* of the heater 52. Therefore, it is possible for the fixing apparatus 50 to deteriorate in the state of contact between the thermally conductive member 54 and substrate 52*a*. If the fixing apparatus 50 deteriorates in the state of contact between the thermally conductive member 54 and substrate 52*a*, it becomes difficult for the heat from the heater 52 to efficiently transfer to the thermally conductive member 54.

Referring to FIG. 6, in this embodiment, therefore, thermally conductive grease is coated as an auxiliary thermally conductive member 57 between the substrate 52*a* and thermally conductive member 54, in order to assure that heat is allowed to efficiently transfer from the heater 52 to the thermally conductive member 54. Therefore, even if the fixing apparatus 50 is made to deteriorate in the state of contact between the thermally conductive member 54 and substrate 52*a* by warping of the substrate 52*a* and/or thermally conductive member 54, which is attributable to the thermal stress, the presence of grease makes it possible for heat to efficiently transfer from the heater 52 to the thermally conductive member 54.

In the cases of the fixing apparatus 50 in this first embodiment of the present invention, it is possible for heat to efficiently transfer from the heater 52 to the thermally conductive member 54, in the area A3 of the heater 52. Therefore, it is possible to reliably prevent the portion of the heater 52, which corresponds in position to the portion of the recording medium passage, which is out of the path of a small sheet of recording medium, from excessively increasing in temperature. In the case of the fixing apparatus 50 in the second embodiment, it is possible for heat to efficiently transfer from the heater 52 to the thermally conductive member 54, in the areas A3 and A5 of the heater 52. Therefore, it is possible to reliably prevent the portion of the heater 52, which corresponds in position to the portion of the recording medium passage, which is outside the path of a small sheet of recording medium, from excessively increasing in temperature.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-097760 filed on May 22, 2018, which is hereby incorporated by reference herein in its entirety.

What is claimed is:

1. A fixing device for fixing an unfixed toner image on a recording material by heat, said fixed device comprising:

a cylindrical film contactable with the unfixed toner image formed on the recording material;

a heater including a substrate and a heat generating resistor provided on said substrate, said substrate having a resistor side on which said heat generating resistor is provided and a non-resistor side opposite from the resistor side, the resistor side being in contact with an inner surface of said film;

a metal member having a thermal conductivity higher than that of said substrate, said metal member being provided on the non-resistor side of said substrate, wherein said substrate is provided with a plurality of non-insulating wiring patterns on the non-resistor side of said substrate, and wherein said metal member is in contact with only one of said wiring patterns and is in contact with said substrate from a position of said substrate outside of an end of said heat generating resistor toward a central portion of said substrate in a direction perpendicular to a recording material feeding direction.

2. The fixing device according to claim 1, wherein, in the perpendicular direction, said metal member extends from the position outside of the end of said heat generating resistor to a position inside of an area where a passing range of a large size recording material overlaps a non-passing region of a small size recording material.

3. The fixing device according to claim 1, wherein in the perpendicular direction, said metal member is provided in a range from the position outside of the end of said heat generating resistor to a position inside of an area where a passing range of a large size recording material overlaps a non-passing region of a small size recording material, and in a range bridging between the non-passing region and a passing range of the small size recording material.

4. The fixing device according to claim 1, further comprising a heat conduction assistance material between said substrate and said metal member.

5. The fixing device according to claim 4, wherein said heat conduction assistance material is thermo-conductive grease.

6. The fixing device according to claim 1, further comprising a temperature detecting member configured to detect a temperature of said heater on the non-resistor side of said substrate, wherein said temperature detecting member is electrically connected with the plurality of non-insulating wiring patterns.

7. The fixing device according to claim 1, further comprising a back-up member cooperative with said heater and said film to form a nip configured to fix the unfixed toner image on the recording material.

* * * * *